US010862197B2

(12) United States Patent
Rahmat-Samii et al.

(10) Patent No.: US 10,862,197 B2
(45) Date of Patent: Dec. 8, 2020

(54) MONOPOLE RECTENNA ARRAYS DISTRIBUTED OVER A CURVED SURFACE FOR MULTI-DIRECTIONAL, MULTI-POLARIZATION, AND MULTI-BAND AMBIENT RF ENERGY HARVESTING

(71) Applicant: The Regents of the University of California, Oakland, CA (US)

(72) Inventors: Yahya Rahmat-Samii, Sherman Oaks, CA (US); Bohan Zhang, Los Angeles, CA (US); Joshua M. Kovitz, Los Angeles, CA (US)

(73) Assignee: The Regents of the University of California, Oakland, CA (US)

( * ) Notice: Subject to any disclaimer, the term of this patent is extended or adjusted under 35 U.S.C. 154(b) by 108 days.

(21) Appl. No.: 16/312,949

(22) PCT Filed: Jun. 27, 2017

(86) PCT No.: PCT/US2017/039555
§ 371 (c)(1),
(2) Date: Dec. 21, 2018

(87) PCT Pub. No.: WO2018/005532
PCT Pub. Date: Jan. 4, 2018

(65) Prior Publication Data

US 2019/0363427 A1 Nov. 28, 2019

Related U.S. Application Data

(60) Provisional application No. 62/355,325, filed on Jun. 27, 2016.

(51) Int. Cl.
*H01Q 1/24* (2006.01)
*H01Q 5/385* (2015.01)
(Continued)

(52) U.S. Cl.
CPC ..... *H01Q 1/248* (2013.01); *H01Q 5/385* (2015.01); *H01Q 9/30* (2013.01); *H01Q 21/20* (2013.01)

(58) Field of Classification Search
CPC ..... H01Q 1/248; H01Q 5/385; H01Q 9/30; H01Q 21/20
See application file for complete search history.

(56) References Cited

U.S. PATENT DOCUMENTS 4,943,811 A 7/1990 Alden et al.
5,489,914 A 2/1996 Breed
(Continued)

FOREIGN PATENT DOCUMENTS

WO 2015019106 A2 2/2015
WO 2018005532 A1 1/2018
WO 2018005532 A8 2/2019

OTHER PUBLICATIONS

International Preliminary Report on Patentability for International Application No. PCT/US2017/039555, Report dated Jan. 1, 2019, dated Jan. 10, 2019, 6 Pgs.
(Continued)

*Primary Examiner* — Hoang V Nguyen
(74) *Attorney, Agent, or Firm* — KPPB LLP

(57) ABSTRACT

Monopole rectenna arrays distributed over a curved surface for multi-directional, multi-polarization, and multi-band ambient RF energy harvesting in accordance with embodiments of the invention are disclosed. In one embodiment, a rectenna array includes a curved grounding surface, a plurality of multi-band antennas distributed across the surface of the curved grounding surface and configured to harvest RF energy in multiple spectral bands, from multiple directions, and with multiple polarizations, a multi-band rectifier connected to an output of each of the plurality of multi-band antennas, and a direct current (DC) combiner including a
(Continued)

plurality of inputs connected to outputs of the multi-band rectifiers and an output configured to provide DC power to a load.

10 Claims, 7 Drawing Sheets

(51) Int. Cl.
*H01Q 9/30* (2006.01)
*H01Q 21/20* (2006.01)

(56) References Cited

U.S. PATENT DOCUMENTS

| | | | | |
|---|---|---|---|---|
| 5,570,102 | A * | 10/1996 | Kochiyama | H01Q 1/248 343/880 |
| 7,400,253 | B2 | 7/2008 | Cohen | |
| 8,129,681 | B2 | 3/2012 | Chun | |
| 2007/0109121 | A1 | 5/2007 | Cohen | |
| 2007/0205881 | A1 | 9/2007 | Breed | |
| 2009/0102716 | A1 | 4/2009 | Sego | |
| 2009/0200985 | A1 | 8/2009 | Zane et al. | |
| 2009/0322285 | A1 | 12/2009 | Hautanen | |
| 2010/0032001 | A1 | 2/2010 | Brantner | |
| 2010/0259447 | A1 | 10/2010 | Crouch | |
| 2010/0270967 | A1 | 10/2010 | Cho et al. | |
| 2012/0155134 | A1 | 6/2012 | Kim et al. | |
| 2012/0267982 | A1 | 10/2012 | Carman et al. | |
| 2014/0290950 | A1 | 10/2014 | Welsh et al. | |
| 2014/0340274 | A1 | 11/2014 | Montgomery et al. | |
| 2015/0048682 | A1 | 2/2015 | Murley | |
| 2015/0171658 | A1 | 6/2015 | Manova-Elssibony et al. | |
| 2016/0099749 | A1 | 4/2016 | Bennett et al. | |

OTHER PUBLICATIONS

International Search Report and Written Opinion for International Application No. PCT/US2017/039555, Search completed Aug. 21, 2017, dated Sep. 8, 2017, 12 Pgs.

Breed, G. "The coupled-resonator principle: a flexible method for multiband antennas", ARRL Antenna Compendium, vol. 5, 1st ed. Newington, CT: ARRL Inc., 1996-99, pp. 109-112.

Hagerty et al., "Recycling ambient microwave energy with broad-band rectenna arrays", IEEE Transactions on Microwave Theory and Techniques, vol. 52, Issue 3, Mar. 2004, pp. 1014-1024.

Pineula et al., "Ambient RF Energy Harvesting in Urban and Semi-Urban Environments", IEEE Transactions on Microwave Theory and Techniques, vol. 61, Issue 7, Jul. 2013, pp. 2715-2726.

Popovic, Zoya, "Cut the Cord", IEEE Microwave Magazine, vol. 14, Issue 2, Mar.-Apr. 2013, pp. 55-62.

Shariati et al., "Multi-Service Highly Sensitive Rectifier for Enhanced RF Energy Scavenging", Scientific Reports, vol. 5, Article 9655, May 7, 2015, pp. 1-9.

* cited by examiner

MONOPOLE RECTENNA ARRAYS DISTRIBUTED OVER A CURVED SURFACE FOR MULTI-DIRECTIONAL, MULTI-POLARIZATION, AND MULTI-BAND AMBIENT RF ENERGY HARVESTING

CROSS REFERENCE TO RELATED APPLICATIONS

This application is a national stage of PCT Patent Application No. PCT/US2017/039555, entitled "Monopole Rectenna Arrays Distributed Over a Curved Surface for Multi-Directional, Multi-Polarization, and Multi-Band Ambient RF Energy Harvesting" to Rahmat-Samii et al., filed Jun. 27, 2017, which claims priority to U.S. Provisional Application No. 62/355,325, entitled "Spherical Monopole Rectenna Arrays for Multi-Directional, Multi-Polarization, and Multi-Band Ambient RF Energy Harvesting" to Zhang et al., filed Jun. 27, 2016, the disclosures of which are incorporated by reference herein in their entirety.

FIELD OF THE INVENTION

The present invention relates generally to energy harvesting and more specifically to ambient RF energy harvesting.

BACKGROUND

Harvesting ambient radio-frequency (RF) energy is potentially a sustainable and environmentally responsible source of energy. To harvest RF energy, a device called a rectenna can be used, which includes an antenna and rectifier circuit. Many environments offer available energy contained within select bands of spectrum that correspond to popular communication channels such as GSM bands, 4G, LTE, and WLAN.

SUMMARY OF THE INVENTION

Monopole rectenna arrays distributed over a curved surface for multi-directional, multi-polarization, and multi-band ambient RF energy harvesting in accordance with embodiments of the invention are disclosed. In one embodiment, a rectenna array includes a curved grounding surface, a plurality of multi-band antennas distributed across the surface of the curved grounding surface and configured to harvest RF energy in multiple spectral bands, from multiple directions, and with multiple polarizations, a multi-band rectifier connected to an output of each of the plurality of multi-band antennas, and a direct current (DC) combiner including a plurality of inputs connected to outputs of the multi-band rectifiers and an output configured to provide DC power to a load.

In a further embodiment, the curved grounding surface is hemispherical.

In another embodiment, the curved grounding surface is a portion of a sphere.

In a still further embodiment, the curved grounding surface is ellipsoidal.

In still another embodiment, the curved grounding surface is parabolic.

In a yet further embodiment, the plurality of multi-band antennas are coupled-resonator monopole antennas.

In yet another embodiment, the coupled-resonator monopole antennas include three separate quarter wavelength antenna elements.

In a further embodiment again, each multi-band rectifier includes a plurality of branches that each include a band-pass filter, an impedance matching stage, and a rectification stage including at least one Schottky diode.

In another embodiment again, the plurality of multi-band antennas are on the outer convex surface of the grounding surface and the multi-band rectifier and direct current combiner are inside the grounding surface.

In a further additional embodiment, each multi-band rectifier includes an impedance matching circuit configured to match the impedance of each multi-band antenna before rectification.

In another additional embodiment, each multi-band rectifier includes a band-pass filter prior to the impedance matching circuit.

DETAILED DESCRIPTION

Turning now to the drawings, rectenna arrays for ambient RF (radio frequency) energy harvesting in accordance with various embodiments of the invention are illustrated. Harvesting ambient radio-frequency (RF) energy is potentially a sustainable and environmentally responsible source of energy. To harvest RF energy, a device called a rectenna is typically used, which includes an antenna and a rectifier circuit. Ambient RF energy is typically distributed across the spectral band. Available ambient RF energy is typically concentrated within the spectral bands allocated for cellular data communications and WiFi communications. To make matters more challenging, propagation effects like multipath, scattering, random source orientations, and diffraction tend to make ambient radiation both multi-polarized and multi-directional. Maximizing harvested energy output can involve designing a rectenna array that can receive multiple frequency bands of interest as well as receive waves of multiple polarizations and incident directions. In many embodiments, a rectenna array is utilized that includes multi-band antennas and rectifiers. In a number of embodiments, each element is rectified to DC before being combined. In certain embodiments, each rectenna is a coupled-resonator monopole designed for use on a hemispherical ground plane. These monopoles can be densely arranged above a hemispherical ground plane for multi-polarization and multi-directional operation. The hemispherical ground plane provides shielding, reducing the interactions between the DC conversion circuitry and antennas. In other embodiments, a variety of multi-band antenna designs and ground plane shapes can be utilized that orient the array of antennas to accommodate harvesting of ambient energy from multiple directions and/or with respect to multiple polarizations as appropriate to the requirements of a given application. For example, a ground plane may be shaped with other different curvatures, such as a portion of a spherical surface, ellipsoidal, parabolic, or irregularly curved surfaces. Typically, the design of a ground plane in accordance with certain embodiments of the invention involves tilting or rotating each antenna element independently for angular and/or spatial diversity in capturing waves of different directions and polarizations. Because a ground plane in accordance with many embodiments of the invention is typically not flat, it may also be referred to here as a grounding surface. Rectenna arrays in accordance with various embodiments of the invention are discussed further below.

Rectenna Arrays

Figure 1:
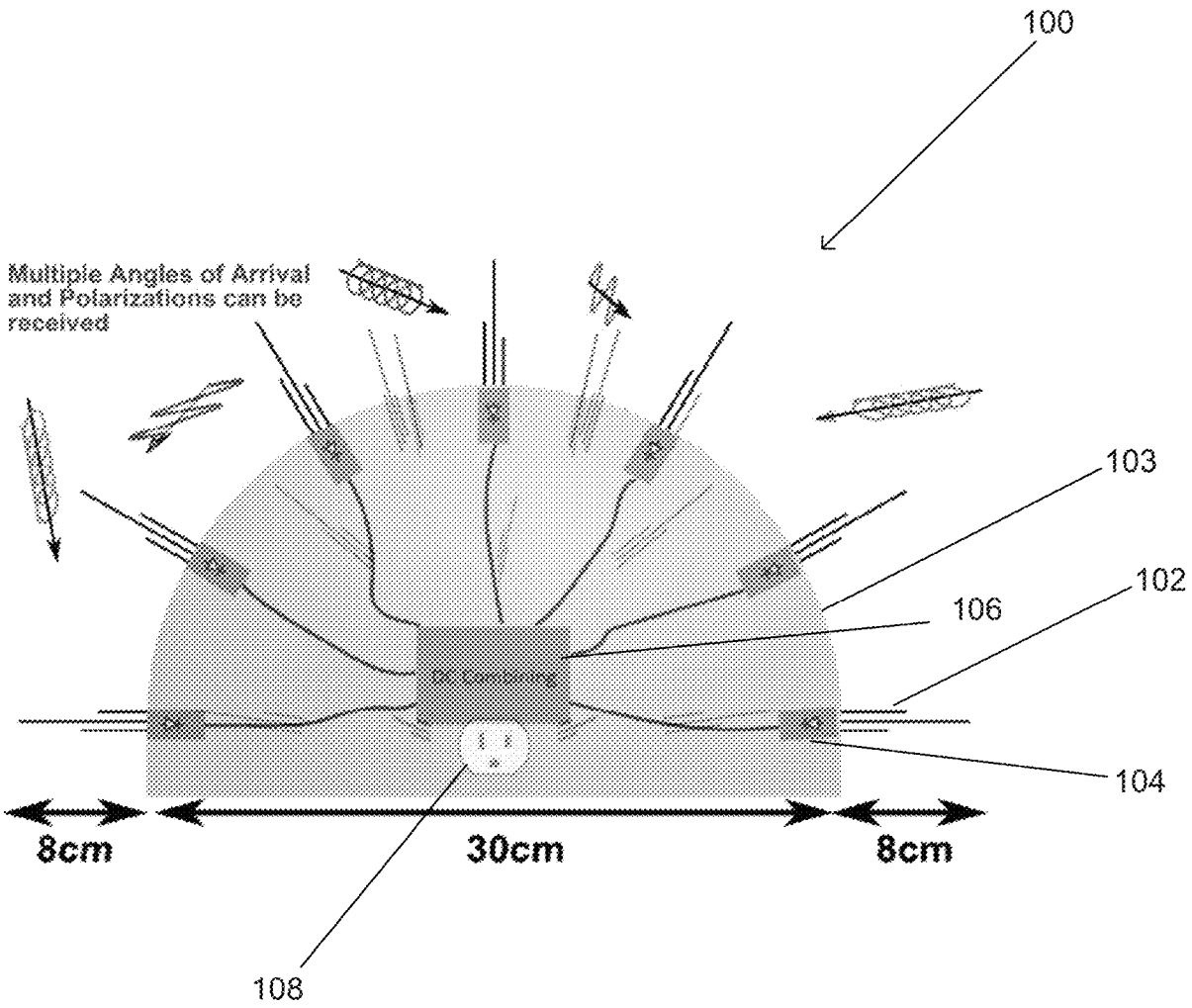
FIG. 1 illustrates a hemispherical rectenna array in accordance with an embodiment of the invention.

A hemispherical rectenna array in accordance with an embodiment of the invention is illustrated in FIG. 1. The hemispherical rectenna array 100 includes a number of multi-band antennas 102 distributed around the surface of a hemispherical ground plane 103 to enable harvesting of ambient RF energy from different directions and/or having different polarizations. In the illustrated embodiment, the multi-band antennas are coupled-resonator monopoles. As is discussed further below, any of a variety of multi-band antennas can be utilized as appropriate to the requirements of a given application in accordance with different embodiments of the invention.

The multi-band antennas 102 capture ambient RF energy to provide induced electrical current to multi-band rectifier circuits 104, each of which outputs a direct current (DC) signal to a DC combining circuit 106. The DC combining circuit combines the DC signals from the rectifiers into a single output current. In many embodiments, the output current is DC that is provided via an output 108. In a number of embodiments, the output is converted to AC that is provided via an output 108. The specific output current characteristics are largely dependent upon the requirements of a given application and/or the available RF energy. In several embodiments, the spacing or distance between multi-band antennas 102 can be chosen to reduce the appearance of grating lobes at higher frequencies and/or to reduce mutual coupling across different antennas.

Figure 2:
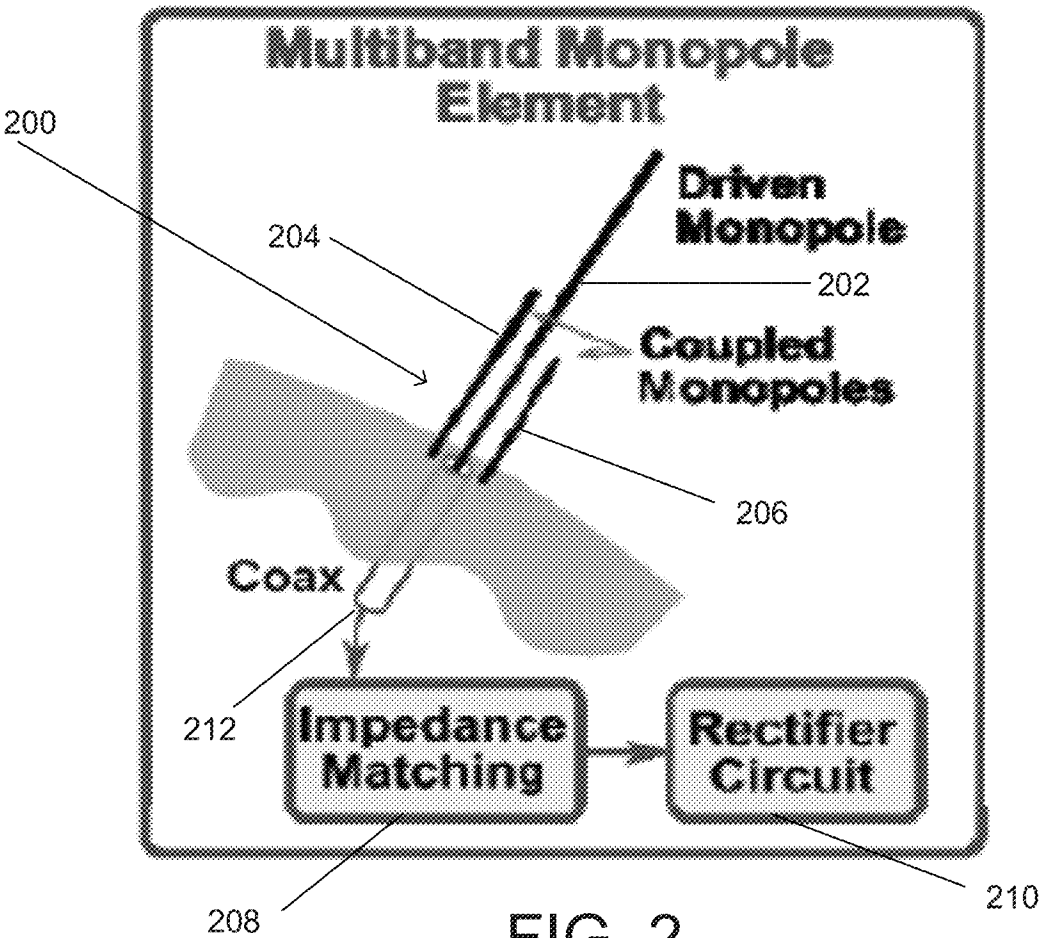
FIG. 2 illustrates a multi-band antenna connected to rectification circuitry that can be used to harvest energy and output DC current in accordance with an embodiment of the invention.

A multi-band antenna connected to rectification circuitry used to harvest energy and output DC current in accordance with an embodiment of the invention is illustrated in FIG. 2. The multi-band antenna 200 includes antenna elements 202, 204, and 206. Each antenna element has a length that is appropriate for the wavelength and/or spectral band of the radio waves that it is designed to receive. In several embodiments, the multi-band antenna is a coupled resonator design that includes a driven monopole 202 and two coupled monopoles 204 and 206. Characteristic to coupled resonators, the coupled monopoles 204 and 206 need not be physically connected to the driven monopole 202. The output 212 of the driven monopole 202 is connected to impedance matching 208 and rectifier 210 circuitry. The output 212 may be a coaxial connection or any type of connection that may be appropriate to the particular application in accordance with embodiments of the invention. In many embodiments, the antennas are on the outer surface of the ground plane while the impedance matching and rectifier circuitry are inside the ground plane.

Figure 3:
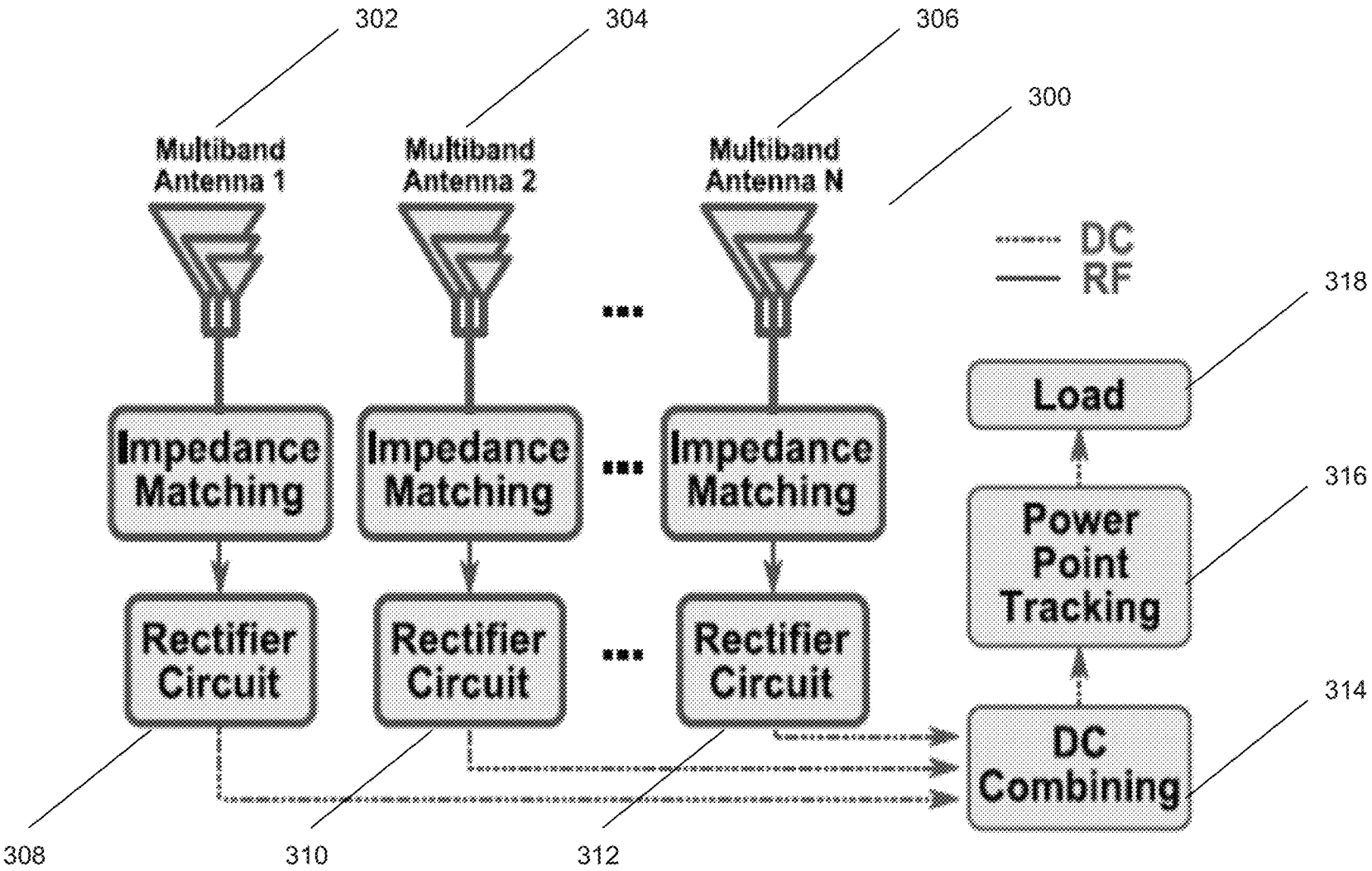
FIG. 3 illustrates circuitry that can be utilized to combine DC from an array of multi-band antennas in accordance with an embodiment of the invention.

Circuitry utilized to combine DC from an array of multi-band antennas in accordance with an embodiment of the invention is shown in FIG. 3. The rectenna array 300 includes multiband antennas 302, 304, and 306 for up to N antennas. Each multiband antenna 302, 304, and 306 feeds an impedance matching and rectifier circuit 308, 310, and 312. The rectifier circuits 308, 310, and 312 are connected to a DC combining circuit 314 that combines the signals, which is connected to a power point tracking circuit 316 that produces a load 318.

While specific rectenna arrays configurations are described above with respect to FIGS. 1-3, any of a variety of ground plane shape, multi-band antenna configurations, and/or multi-band rectification and current combining circuitry can be utilized to harvest ambient RF energy in multiple spectral bands, from multiple directions, and/or from multiple polarizations as appropriate to the requirements of specific applications in accordance with various embodiments of the invention. Multi-band antenna and rectifier designs in accordance with a number of embodiments of the invention are discussed further below.

Coupled Resonators

The coupled-resonator approach combines the resonances of individual antennas using the principle of mutual coupling by having a driven conductor radiate in the presence of parasitic conductors. This approach allows for flexible impedance matching and independent tuning at each frequency band of interest. Second, it simplifies the feeding system, as multiple conductors can be driven by a single feed. Third, reasonable radiation efficiencies can be maintained using coupled resonators. Discussion of coupled-resonator architectures that may be utilized in accordance with embodiments of the invention can be found in "The Coupled-Resonator Principle: a Flexible Method for Multi-band Antennas," by Gary Breed, ARRL Antenna Compendium Vol. 5, 1st ed., Newington, Conn.: ARRL Inc., 1996-99, the relevant portions of which are hereby incorporated by reference.

Figure 4:
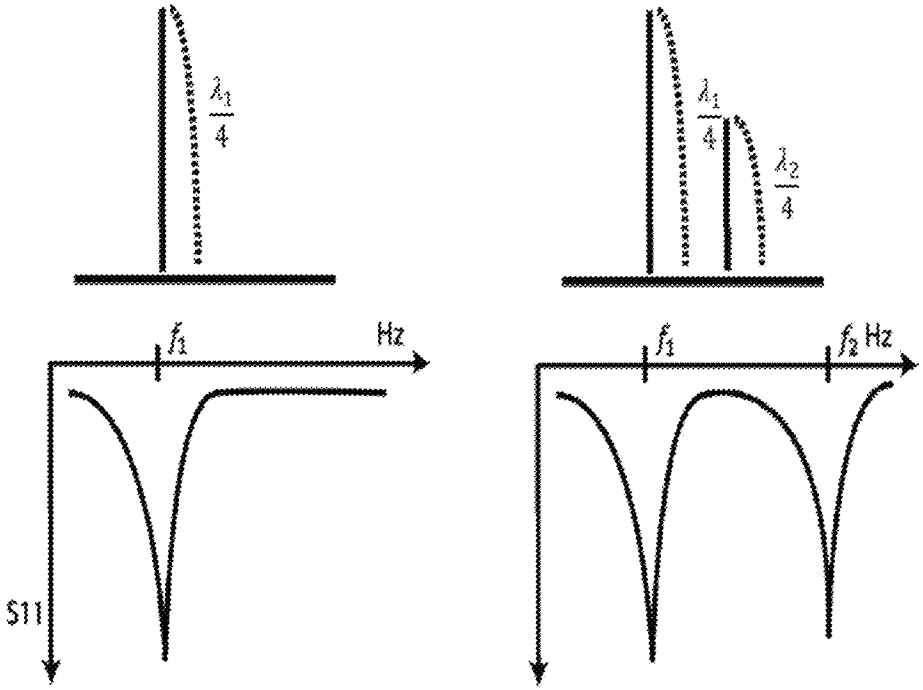
FIG. 4 illustrates a multi-band antenna constructed using mutually coupled monopoles in accordance with an embodiment of the invention.

In many embodiments, a coupled-resonator monopole antenna with triple band operation is utilized as a multi-band antenna. The manner in which a multi-band antenna can be constructed using mutual coupling for dual band operation is conceptually illustrated in FIG. 4. A driven quarter wavelength monopole of length $\lambda_1/4$ with resonant frequency of $f_1$ is placed over a ground plane and fed by a coaxial feed. A parasitic monopole of length $\lambda_2/4$ with resonance at $f_2$ is placed a distance $d_2$ away from the driven monopole. The graph of $S_{11}$ of the driven monopole shows a dip at its resonant frequency $f_1$ and a dip induced by the parasitic monopole at its resonant frequency $f_2$.

Figure 5:
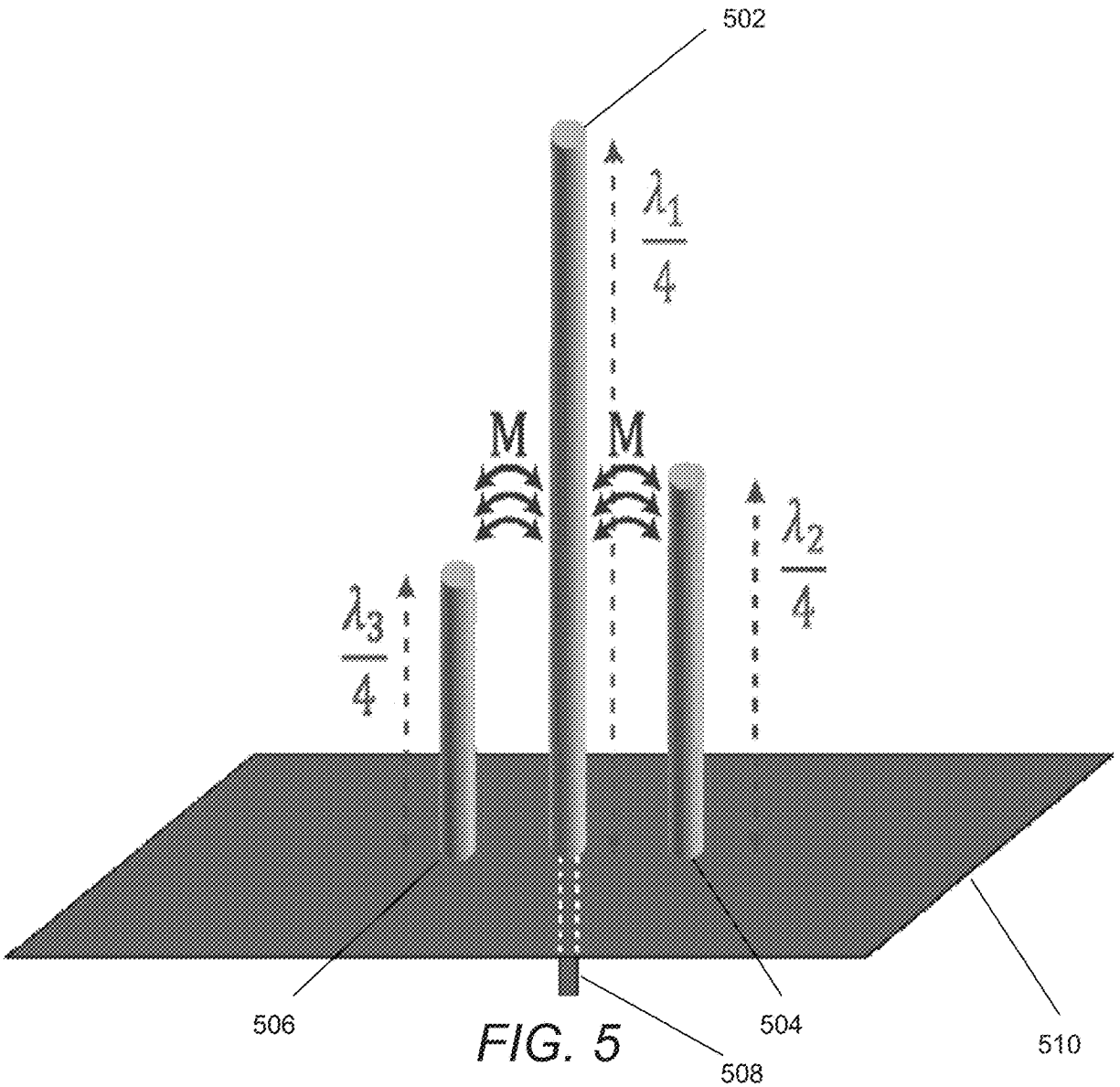
FIG. 5 illustrates a coupled-resonator monopole antenna with triple band operation in accordance with an embodiment of the invention.
Figure 6:
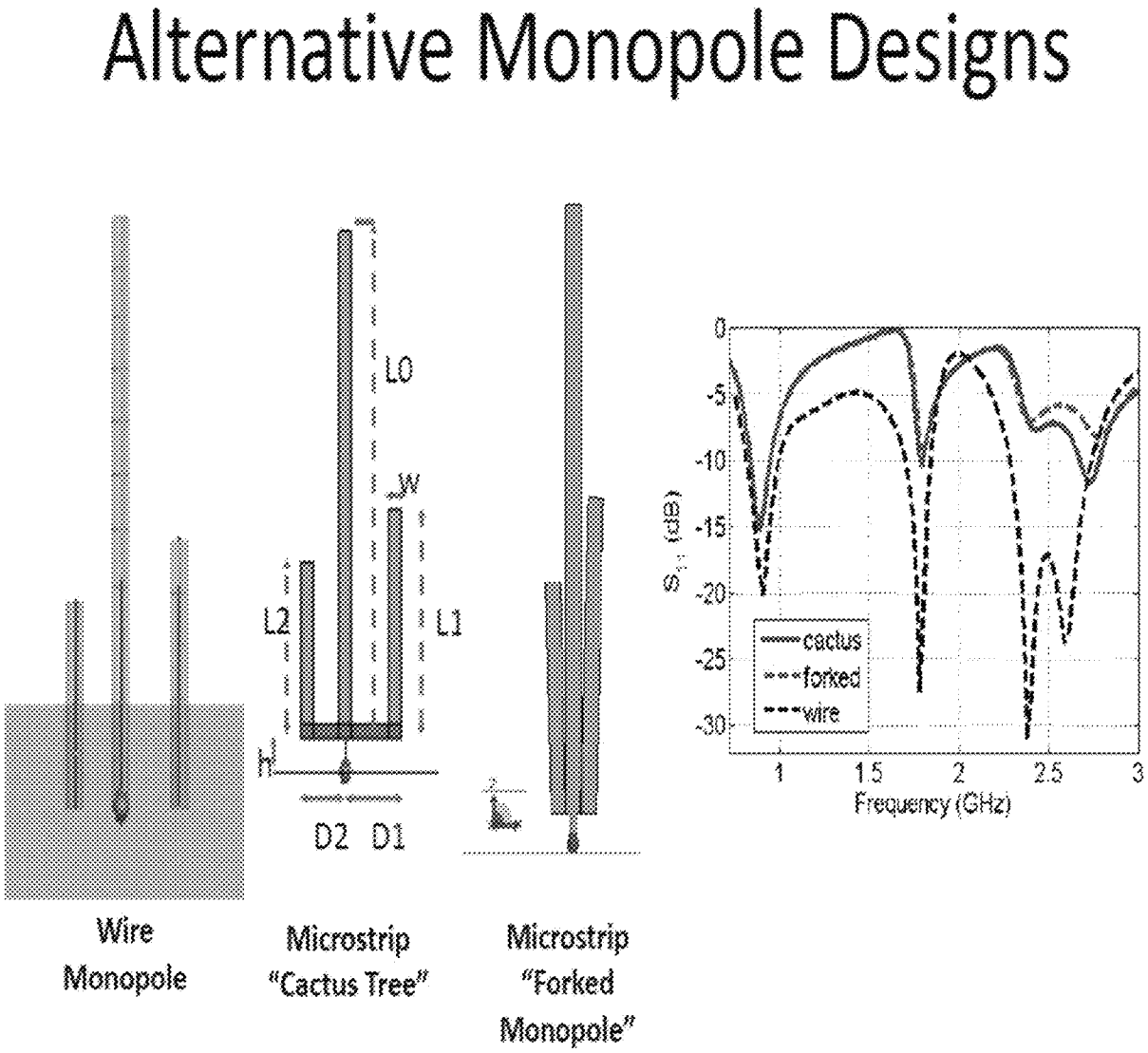
FIG. 6 illustrates alternative multiband antenna element configurations in accordance with embodiments of the invention.

A coupled-resonator monopole antenna with triple band operation in accordance with an embodiment of the invention is illustrated in FIG. 5. Using the coupled-resonator approach, three separate quarter wavelength monopole wires 502, 504, and 506 designed with resonances at 900 MHz, 1.8 GHz, and 2.4 GHz are combined into an antenna with a single coaxial feed 508. As shown in FIG. 5, the shorter wires couple to the driven monopole and resonate without necessarily being directly connected. In various embodiments, the parasitic monopoles may be insulated using dielectric materials. In several embodiments, the spacing or distance between monopoles within a coupled-resonator antenna is selected to provide a desired frequency response. The resulting antenna typically has good impedance matching at the frequency bands of interest. As can readily be appreciated, a coupled-resonator monopole antenna can be constructed to harvest energy from any of a variety of bands appropriate to the requirements of a given application. In various embodiments, greater or fewer than three monopoles may be utilized as may be appropriate to achieve a desired frequency response. Furthermore, rectenna arrays in accordance with embodiments of the invention are not limited to the use of coupled-resonator monopole antennas. Alternative antenna element configurations include (but are not limited to) the antenna designs illustrated in FIG. 6. Additional configurations can include a microstrip cactus tree and microstrip forked monopole. In some embodiments, the antenna elements are connected together, while in other embodiments the antenna elements are not connected together and/or may be insulated from each other. One skilled in the art will recognize that any of a variety of antenna configurations may be utilized in accordance with embodiments of the invention to capture multi-band RF energy as appropriate to the requirements of specific applications in accordance with various embodiments of the invention.

Multi-Band Rectification

Figure 7B:
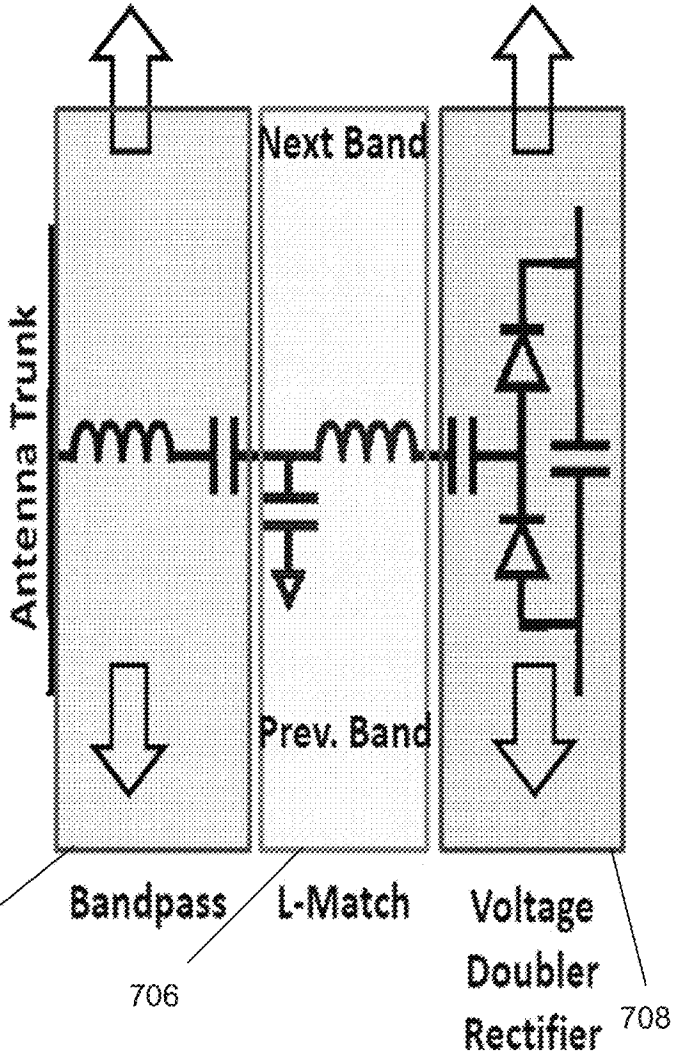
FIG. 7B illustrates a branch of a multi-band rectifier including a passive LC bandpass filter in series with an impedance matching circuit tuned to match the impedance of the multi-band antenna within the selected spectral band in accordance with many embodiments of the invention.
Figure 7A:
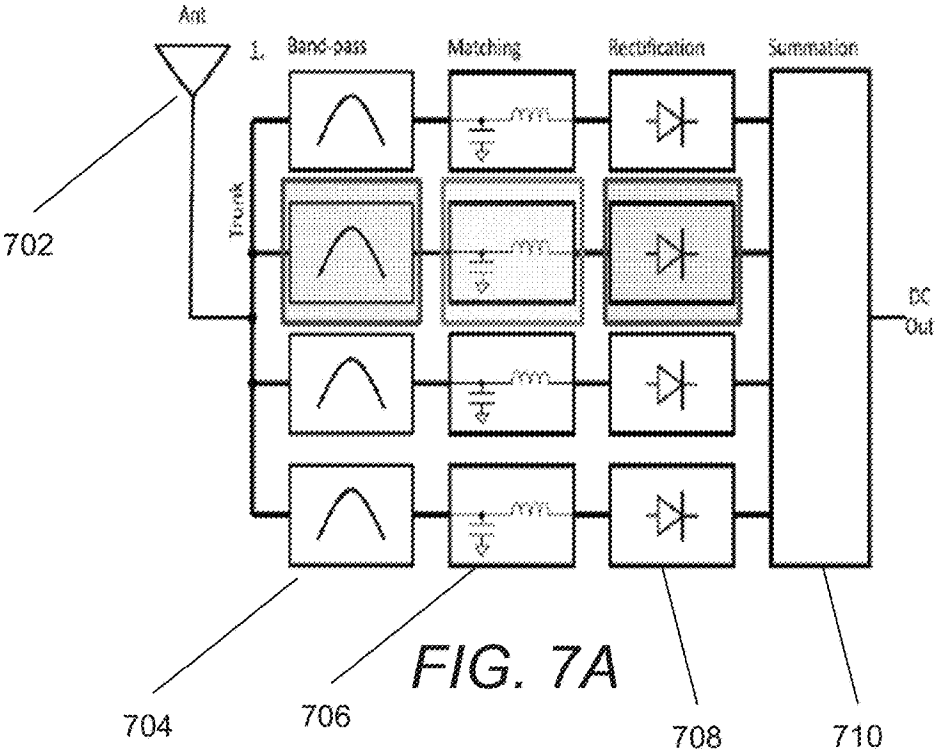
FIG. 7A illustrates a multi-band rectifier utilizing a band-pass filter to separate the output into spectral bands in accordance with an embodiment.

Schottky diodes are typically utilized by rectennas to provide rectification. A challenge associated with the use of Schottky diodes is that they tend to have poor efficiencies at low input power levels. Accordingly, use of an impedance matching stage prior to a Schottky diode can significantly increase power efficiency. Impedance matching can be challenging with respect to multi-band antennas. Accordingly, rectenna arrays in accordance with many embodiments of the invention utilize multi-band rectifiers. A multi-band rectifier in accordance with an embodiment of the invention is illustrated in FIG. 7A in which the output of the multi-band antenna 702 is separated using band-pass filters 704 having different pass bands. An example of a branch of a multi-band rectifier that can be utilized in accordance with many embodiments of the invention illustrated in FIG. 7B and includes a passive LC bandpass filter 704 in series with an impedance matching circuit 706 tuned to match the impedance of the multi-band antenna within the selected spectral band. The output of the impedance matching stage is provided to a voltage doubler rectifier circuit 708 that outputs DC in combination with DC generated by other branches of the multi-band rectifier. The outputs of the rectifiers 708 are combined by summation circuit 710.

While specific multi-band rectifier designs are described above with respect to FIGS. 7A and 7B, any of a variety of multi-band rectifier designs that achieve efficient conversion of induced RF currents to DC in a manner compatible with the requirements of a given application can be utilized in accordance with various embodiments of the invention.

Although the present invention has been described in certain specific aspects, many additional modifications and variations would be apparent to those skilled in the art. It is therefore to be understood that the present invention may be practiced otherwise than specifically described, including various changes in the implementation such as the use of antennas and/or rectifiers other than those described herein, without departing from the scope and spirit of the present invention. Thus, embodiments of the present invention should be considered in all respects as illustrative and not restrictive.

What is claimed is:

1. A rectenna array comprising:

a curved grounding surface;

a plurality of multi-band antennas distributed across the surface of the curved grounding surface and configured to harvest RF energy in multiple spectral bands, from multiple directions, and with multiple polarizations;

a multi-band rectifier connected to an output of each of the plurality of multi-band antennas; and a direct current (DC) combiner including a plurality of inputs connected to outputs of the multi-band rectifiers and an output configured to provide DC power to a load;

wherein the plurality of multi-band antennas are on the outer convex surface of the grounding surface and the multi-band rectifier and direct current combiner are inside the grounding surface.

2. The rectenna array of claim 1, wherein the curved grounding surface is hemispherical.

3. The rectenna array of claim 1, wherein the curved grounding surface is a portion of a sphere.

4. The rectenna array of claim 1, wherein the curved grounding surface is ellipsoidal.

5. The rectenna array of claim 1, wherein the curved grounding surface is parabolic.

6. The rectenna array of claim 1, wherein the plurality of multi-band antennas are coupled-resonator monopole antennas.

7. The rectenna array of claim 6, wherein the coupled-resonator monopole antennas include three separate quarter wavelength antenna elements.

8. The rectenna array of claim 1, wherein each multi-band rectifier comprises a plurality of branches that each comprise a band-pass filter, an impedance matching stage, and a rectification stage comprising at least one Schottky diode.

9. The rectenna array of claim 1, wherein each multi-band rectifier includes an impedance matching circuit configured to match the impedance of each multi-band antenna before rectification.

10. The rectenna array of claim 1, wherein each multi-band rectifier includes a band-pass filter prior to the impedance matching circuit.

* * * * *